US007552564B2

(12) United States Patent
Kressin

(10) Patent No.: US 7,552,564 B2
(45) Date of Patent: Jun. 30, 2009

(54) STAIRCASE INSTALLATION TEMPLATE AND METHOD

(75) Inventor: Rick Lee Kressin, Neenah, WI (US)

(73) Assignee: Arcways, Inc., Neenah, WI (US)

( * ) Notice: Subject to any disclaimer, the term of this patent is extended or adjusted under 35 U.S.C. 154(b) by 681 days.

(21) Appl. No.: 11/032,308

(22) Filed: Jan. 9, 2005

(65) Prior Publication Data

US 2006/0174557 A1 Aug. 10, 2006

(51) Int. Cl.
*E04F 11/00* (2006.01)

(52) U.S. Cl. ..... 52/187; 52/741.2

(58) Field of Classification Search ..... 52/741.2, 52/187; 434/72; 703/1
See application file for complete search history.

(56) References Cited

U.S. PATENT DOCUMENTS

| | | | | |
|---|---|---|---|---|
| 3,393,481 | A | 7/1968 | Meuret | |
| 4,118,908 | A | 10/1978 | Bucher | |
| 4,580,352 | A * | 4/1986 | Wilson | 33/563 |
| 4,918,799 | A * | 4/1990 | Benedetti | 29/467 |
| 5,163,491 | A | 11/1992 | Smith | |
| 5,309,687 | A | 5/1994 | Walston | |
| 5,347,774 | A | 9/1994 | Smith | |
| 5,502,933 | A | 4/1996 | Skillern | |
| 5,613,341 | A | 3/1997 | Skillern | |
| 5,632,124 | A | 5/1997 | Weingarten et al. | |
| 5,720,136 | A | 2/1998 | Turner | |
| 6,112,480 | A | 9/2000 | Turner | |
| 6,125,598 | A | 10/2000 | Lanphier | |
| 6,397,529 | B1 | 6/2002 | Grenier | |
| 6,516,574 | B1 | 2/2003 | Couture | |
| 2003/0093959 | A1 | 5/2003 | Couture | |
| 2003/0208971 | A1 | 11/2003 | Couture | |

* cited by examiner

*Primary Examiner*—Richard E Chilcot, Jr.
*Assistant Examiner*—Jessica Laux
(74) *Attorney, Agent, or Firm*—Godfrey & Kahn, S.C.

(57) ABSTRACT

A template system and method for use in the installation of and framing for staircases is disclosed. The template system includes a plurality of staircase template pieces that can be assembled to produce a full-scale template of a staircase in plan view. If desired, a plurality of wall plates can be assembled in connection with the staircase templates to provide a full-scale template for framing the staircase. Balcony templates could also be used to provide a full-scale template for a balcony of the staircase.

18 Claims, 10 Drawing Sheets

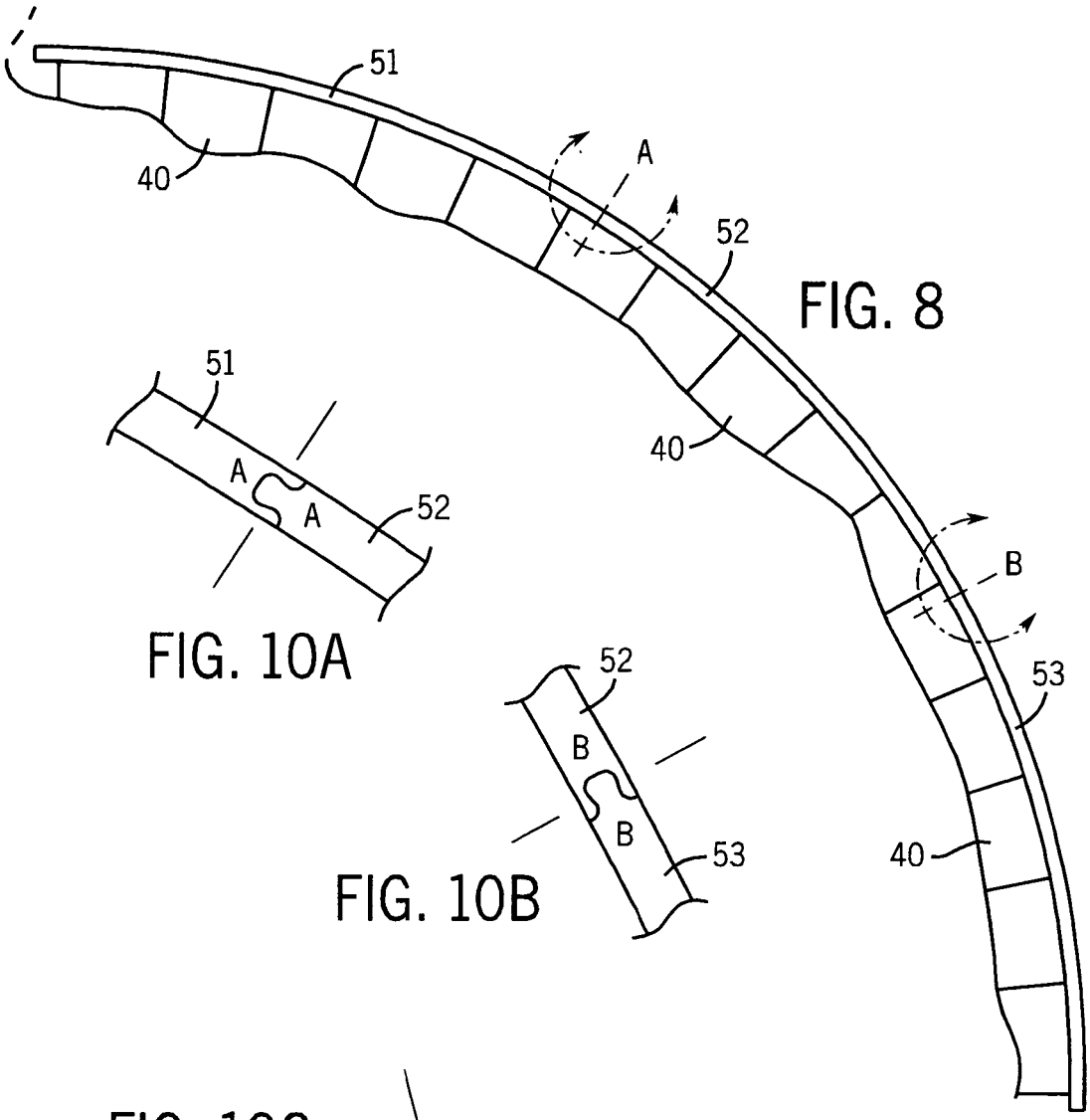
FIG. 8
FIG. 10A
FIG. 10B
FIG. 10C
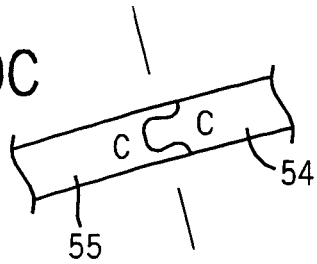
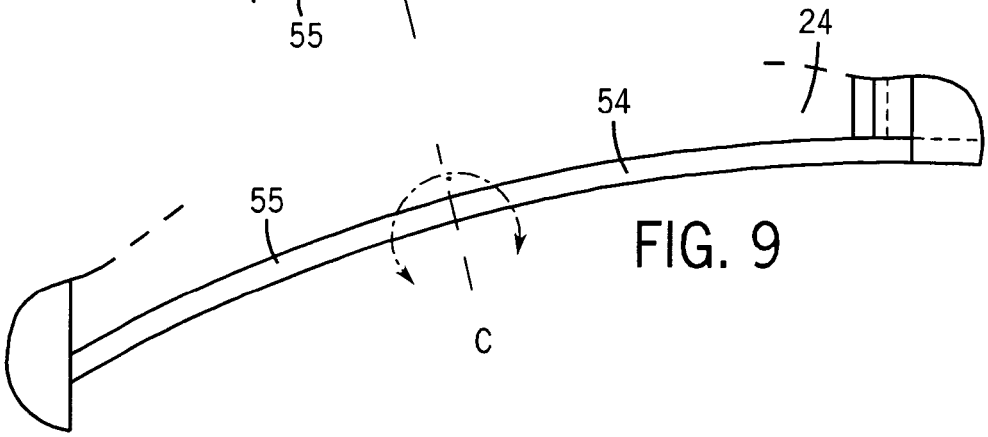
FIG. 9

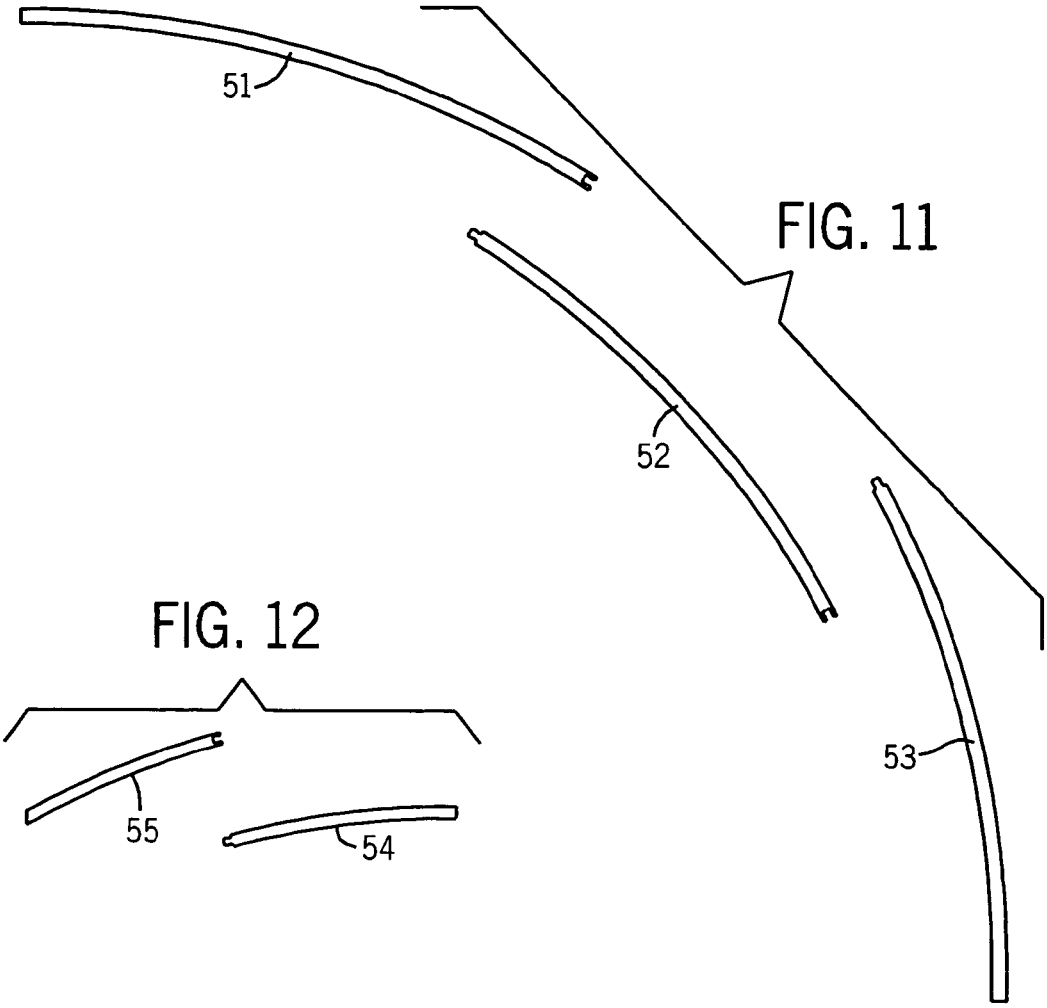
FIG. 11
FIG. 12
FIG. 13
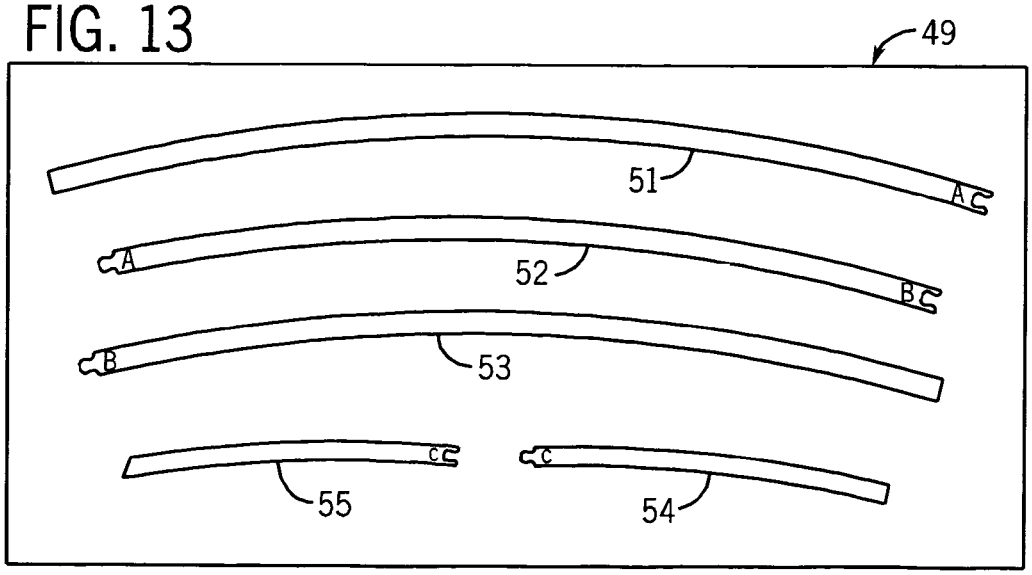

STAIRCASE INSTALLATION TEMPLATE AND METHOD

BACKGROUND OF THE INVENTION

The present invention relates generally to architectural staircases, and more particularly to a staircase installation template and method of use.

The installation of architectural staircases during the construction of residential and commercial buildings can be a complicated process. The residential or commercial builder is typically responsible for installing the framing for the staircase, and a separate staircase manufacturer is responsible for the construction of the staircase. The staircase is thus constructed at a location other than the building construction site and transported in finished or semi-finished form to the building site for installation. Although the builder and the stair manufacturer work from the same set of drawings, there frequently are problems fitting the staircase into the framing when the staircase is installed. It can be very difficult and expensive to fix such problems when they arise. The framing or staircase need to be re-constructed or modified, adding time and expense to the building project. Often, the staircase must be transported back to the staircase manufacturer's facility, adding delay and expense to the project.

To address these problems, some staircase manufacturers have developed new methods for constructing and installing the stairs. Specifically, some staircases can be partially constructed at the building site. The staircase is constructed in various modular parts, and the parts are then transported and assembled at the building site. Such modular staircases are easier to modify, and thus easier to install in the framing. Modular staircases do not completely solve the problems, however, because it can still be difficult to construct the framing in a manner that significantly reduces the modifications necessary to install the staircase. In addition, some architectural staircases cannot be effectively manufactured as a modular staircase unit.

Given the limitations and problems with the existing systems and methods, there exists a need for an improved system and method for installing architectural staircases during the construction of residential and commercial buildings. The present invention relates to improvements over the systems and methods described above, and to solutions to the problems raised or not solved thereby.

SUMMARY OF THE INVENTION

The present invention provides a template system and method for installing a staircase. The template system includes a plurality of staircase template pieces that can be assembled into a complete template. The staircase template pieces, when assembled, form a two dimensional full-scale template of the staircase. The template system and method can also include wall plate pieces that can be assembled into a complete wall plate. The wall plates, when assembled, form a full-scale template for the framing of the staircase, and can be assembled in connection with the staircase template pieces. Balcony template pieces can also be included in the template system of the present invention. The assembled balcony template pieces form a full-scale template for a balcony of the staircase, and can also be assembled in connection with the staircase template pieces. When unassembled, the staircase template pieces, wall plates, and balcony template pieces can easily fit into a conventional commercial shipping container.

The staircase template pieces, wall plates, and balcony template pieces are preferably manufactured using computer-aided drafting (CAD) drawings and computerized numerical control (CNC) machining, but could be manufactured using any number of techniques. Plywood has been found to be an effective material from which to manufacture the staircase template pieces, wall plates, and balcony template pieces, though other materials could be used.

The present invention also contemplates a method for installing a staircase. The method includes the steps of (1) providing a template system having a plurality of staircase template pieces and a plurality of wall plates, (2) assembling the staircase template pieces on a lower floor to form a full-scale template of the staircase in plan view, (3) assembling the wall plates on the lower floor in connection with the staircase template pieces to form a full-scale template for framing the staircase, (4) completing the framing according to the template, and (5) installing the fully or partially pre-manufactured staircase according to the template.

The present invention has several advantages over the existing staircase installation systems and methods. The full-scale template of the present invention provides an accurate and efficient system for framing walls, especially curved walls, to the exact radius and dimensions of the fully or partially pre-manufactured staircase. Using a template system, the walls can be framed prior to the arrival of the preassembled staircase, or prior to the installation of a modular staircase. In addition, balconies can be framed and finished prior to the arrival or installation of the staircase. The use of CNC machined templates, furthermore, provides smooth and true curved walls. Overall, the installation process for the framing, staircase, and balcony is significantly expedited through the use of a template system and method of the present invention.

Various other features, objects, and advantages of the invention will be made apparent to those skilled in the art from the accompanying drawings and detailed description thereof.

BRIEF DESCRIPTION OF THE DRAWINGS

FIG. 8 is a detail plan view showing sections A and B of FIG. 2 illustrating one embodiment of framing wall plates;

FIG. 9 is a detail plan view showing section C of FIG. 2 illustrating one embodiment of framing wall plates;

FIG. 10A is an enlarged view of section A of FIG. 8, illustrating the interlocking shape of one embodiment of the wall plates;

FIG. 10B is an enlarged view of section B of FIG. 8, illustrating the interlocking shape of one embodiment of the wall plates;

FIG. 10C is an enlarged view of section C of FIG. 9, illustrating the interlocking shape of one embodiment of the wall plates;

FIG. 11 is a plan view of the finished shapes of an embodiment of the wall plates;

FIG. 12 is a plan view of the finished shapes of another embodiment of the wall plates;

FIG. 13 illustrates one possible arrangement of the wall plates of FIGS. 11 and 12 in a box representing a sheet of material from which the wall plates will be machined to produce a template in accordance with one embodiment of the present invention;

DETAILED DESCRIPTION OF THE INVENTION

The present invention provides a full-scale template of an architectural staircase that can be used to determine the exact location of the staircase at the construction site. The template shows the builder and customer the actual size and shape of the staircase in plan view. The template is formed of several individual pieces that can interlock together like puzzle pieces. A CAD drawing can accompany the interlocking full-scale template to show construction site dimensions for proper layout of the template. The template can be easily shipped and reassembled at the construction site. The template can be manufactured through the use of computer-aided drafting (CAD) and computerized numerical control (CNC) machining to ensure accuracy and efficiency. One method for manufacturing a template in accordance with the present invention using CAD and CNC machining is described below. Other methods could also be used to create the templates, including methods that do not employ CAD or CNC machining.

Figure 1:
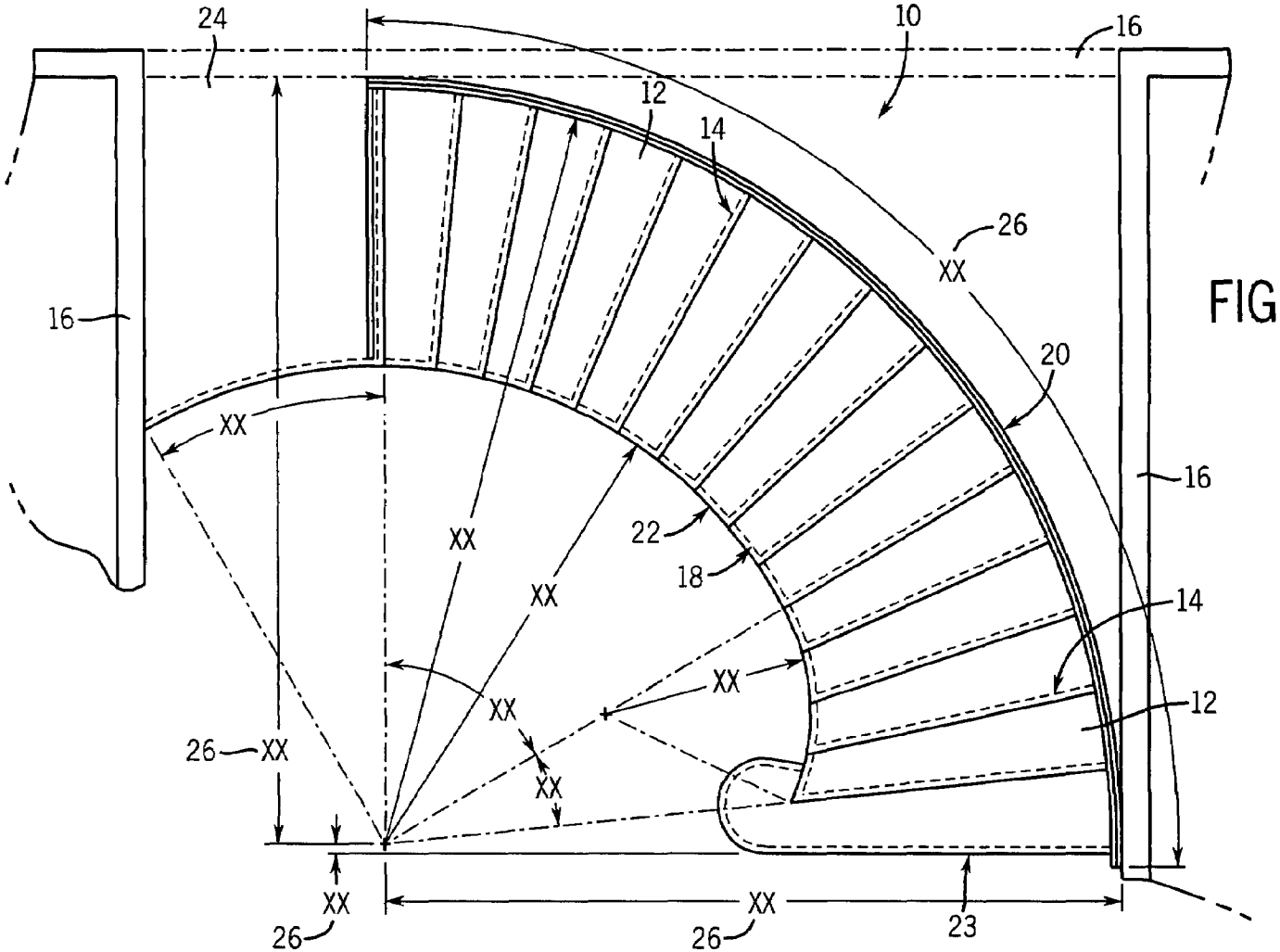
FIG. 1 is a plan view of a curved architectural staircase, from which a template in accordance with one embodiment of the present invention can be manufactured.

Referring now to the drawings, FIG. 1 shows a plan view of a curved architectural staircase from which a template according to the present invention can be manufactured. The staircase 10 includes a plurality of treads 12, and a plurality of risers 14 (indicated by dashed lines). The staircase 10 also includes an inside travel beam 18, an outside travel beam 20, an inside nosing 22, and a front nosing 23. FIG. 1 also shows finished walls 16, a balcony 24 and a plurality of dimension specifications 26. The manufacturing process for the template of the present invention begins by deleting the details from the CAD drawing for the staircase that are unnecessary for the manufacture of the template. For example, FIG. 2 is a drawing of the staircase of FIG. 1 without the unnecessary dimension specifications 26 of FIG. 1.

Figure 2:
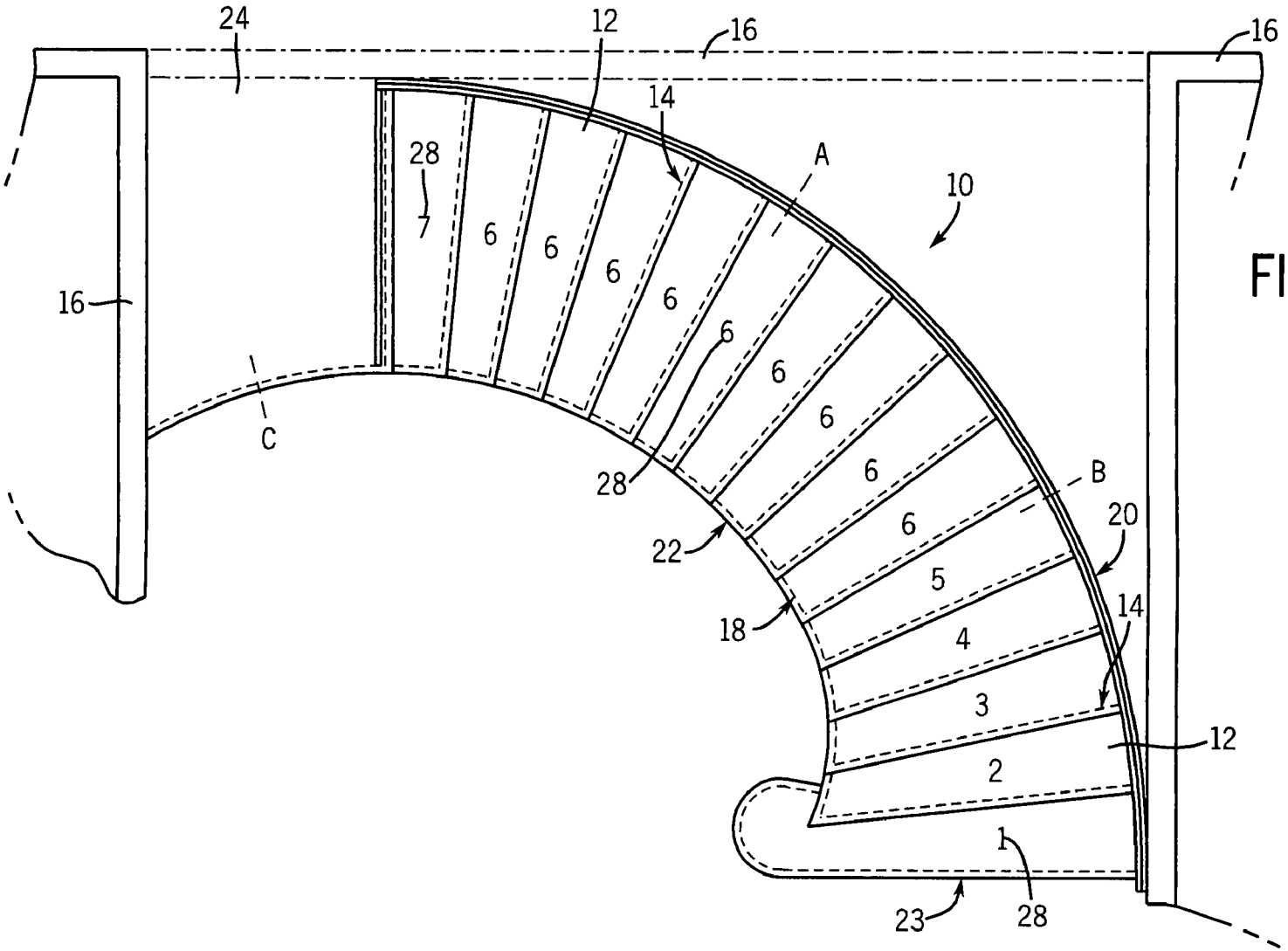
FIG. 2 is a plan view of the staircase of FIG. 1, wherein the dimension specifications have been deleted.

As shown in FIG. 2, the next step in one method of manufacturing a template in accordance with the present invention is determining the number of individual staircase template pieces in the template. One effective way to determine the number of staircase template pieces in the template is to use the same number of staircase template pieces in the template as there are treads in the staircase. In FIG. 2, for example, each tread 12 has a label 28. Each unique label 28 corresponds to unique specifications that will be used to construct the staircase template piece that corresponds to the tread 12 having that label 28. FIG. 2 shows, for instance, multiple treads 12 with the same label 28 of "6." Thus, each of the staircase template pieces corresponding to the treads 12 having the same label 28 of "6" will have the same specifications and therefore the same finished dimensions. Likewise, each of the staircase template pieces corresponding to the treads 12 having different labels 28 will have different finished dimensions.

Figure 3B:
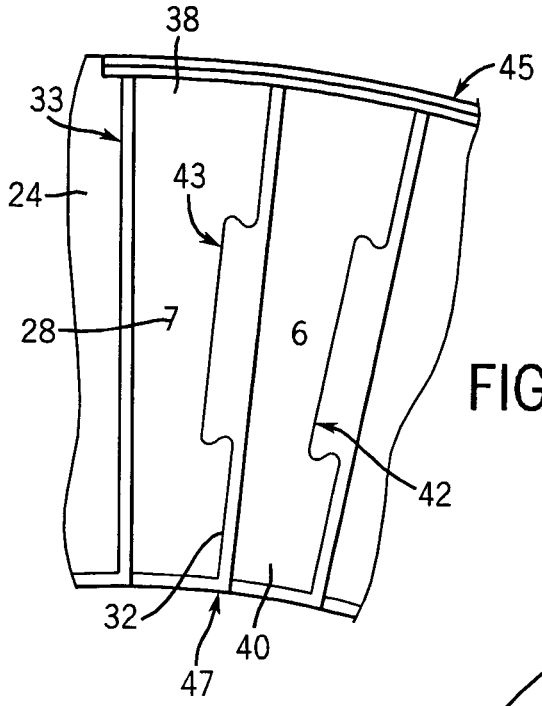
FIGS. 3A and 3B are plan views illustrating the formation of the interlocking shape of staircase template pieces in accordance with one embodiment of the present invention.
Figure 3A:
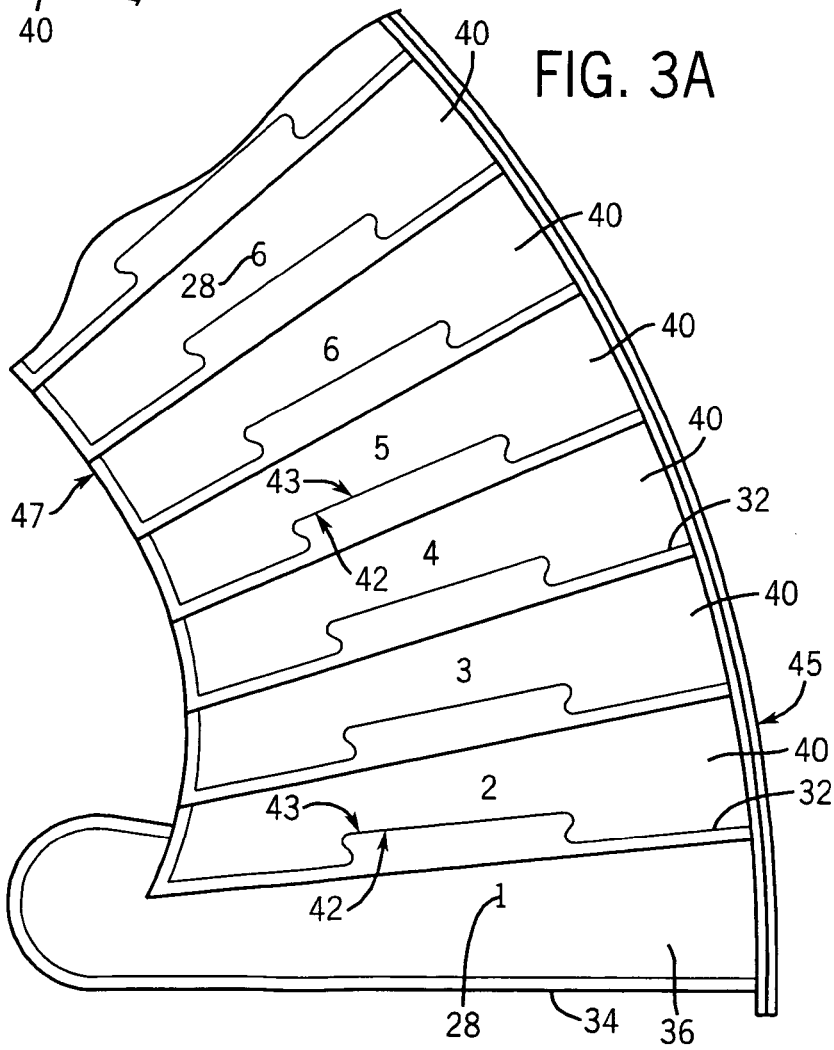

FIGS. 3A and 3B are plan views illustrating the formation of the interlocking shape of the staircase template pieces of the present invention. Once the number of staircase template pieces is determined, the interlocking shape of the staircase template pieces can be determined. FIGS. 3A and 3B show the interlocking shapes of the staircase template pieces, including a bottom staircase template piece 36, a top staircase template piece 38, and interior staircase template pieces 40. Each of the staircase template pieces 36, 40 has an interlocking tongue 42 which mates with a corresponding interlocking groove 43 in another staircase template piece 36, 40. Each tongue 42 extends from, and each groove 43 recedes from, a line 32, which corresponds to the location of a riser 14 of FIGS. 1 and 2. Each interior staircase template piece 40 is bordered on one side by the outside travel beam line 45, on the other side by the inside nosing line 47, on the top by one line 32 including a tongue 42 and on the bottom by another line 32 including a groove 43. The bottom staircase template piece 36 is bordered on one side by the outside travel beam line 45, on the other side and the bottom by the front nosing line 34, and on the top by a line 32 including a tongue 42. The top staircase template piece 38 is bordered on one side by the outside travel beam line 45, on the other side by the inside nosing line 47, on the top by a back riser line 33, and on the bottom by a line 32 including a groove 43. Other shape configurations could be used for the staircase template pieces. For example, the staircase template pieces could have a tongue and groove shape in profile view, as opposed to the tongue and groove shape in plan view described above. Further, the staircase template pieces need not have an interlocking shape. Each of the staircase template pieces could have straight edges that simply abut one another when the pieces are assembled or placed in spaced-relation to one another to create the full-scale template.

Figure 4B:
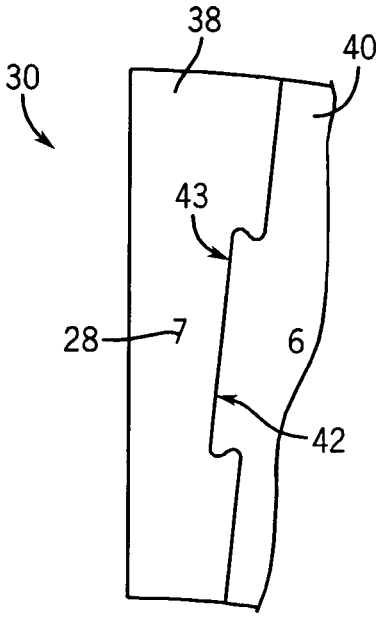
FIGS. 4A and 4B are plan views illustrating the finished shapes and interlocking features of staircase template pieces in accordance with one embodiment of the present invention.
Figure 4A:
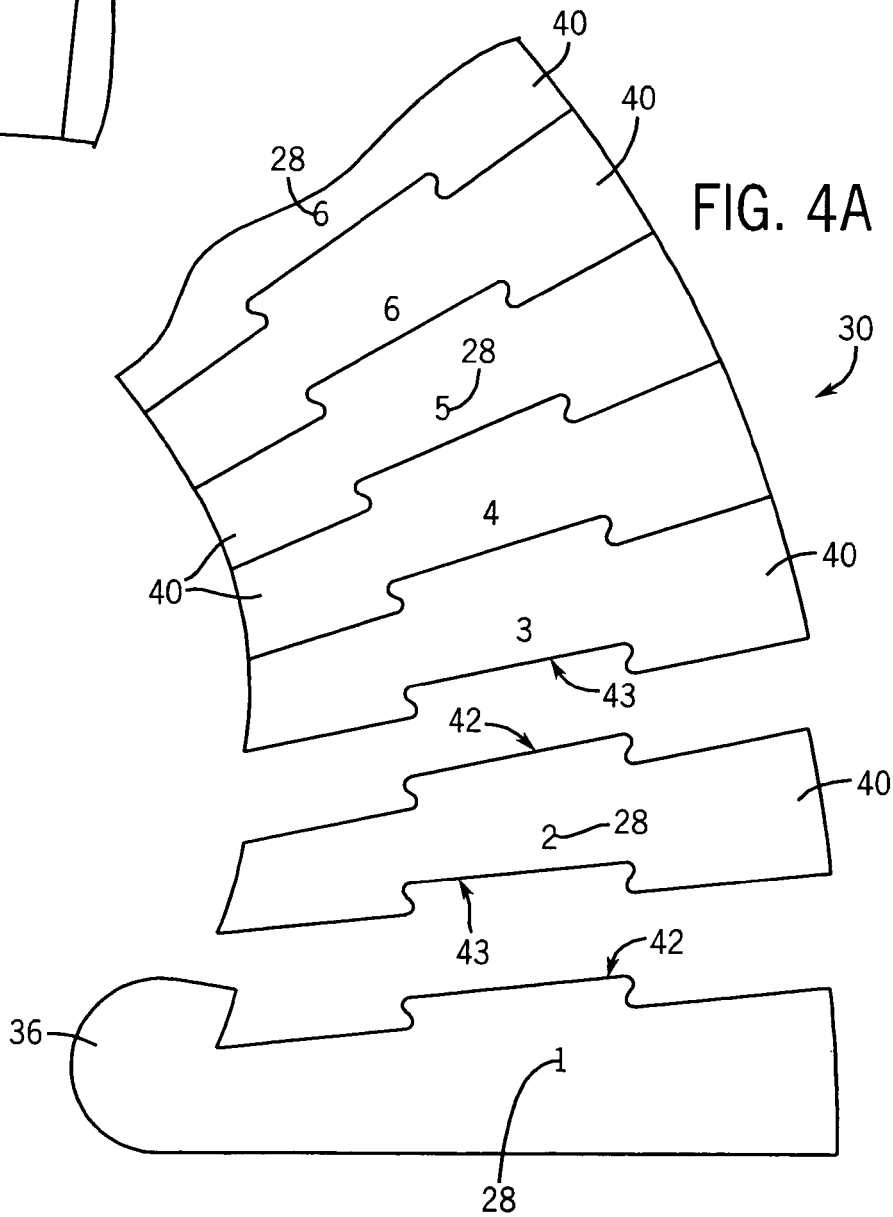

FIGS. 4A and 4B are plan views illustrating the finished shapes and interlocking features of the staircase template pieces of the present invention. The tongue 42 of bottom staircase template piece 36 fits into a corresponding groove 43 on the next interior staircase template piece 40. Likewise, each tongue 42 of each interior staircase template piece 40 fits into a corresponding groove 43 on the next interior staircase template piece 40, and the groove 43 of the top staircase template piece 38 receives the corresponding tongue 42 of the previous interior staircase template piece 40. The staircase template pieces 36, 38, 40 are interlocked in order according to their labels 28. Bottom staircase template piece 36, for example has a label 28 of "1" and the next interior staircase template piece 40, which interlocks with the bottom staircase template piece 36, has a label 28 of "2." As previously described, several of the interior staircase template pieces 40 have a label 28 of "6." Each of the interior staircase template pieces 40 with a label 28 of "6" have the same dimensions, allowing them to interlock with other interior staircase template pieces 40 having the label 28 of "6." Each of the interior staircase template pieces 40 with a label 28 of "6" can also interlock with the interior staircase template piece 40 having a label 28 of "5" and the top staircase template piece 38 having the label 28 of "7."

Figure 5:
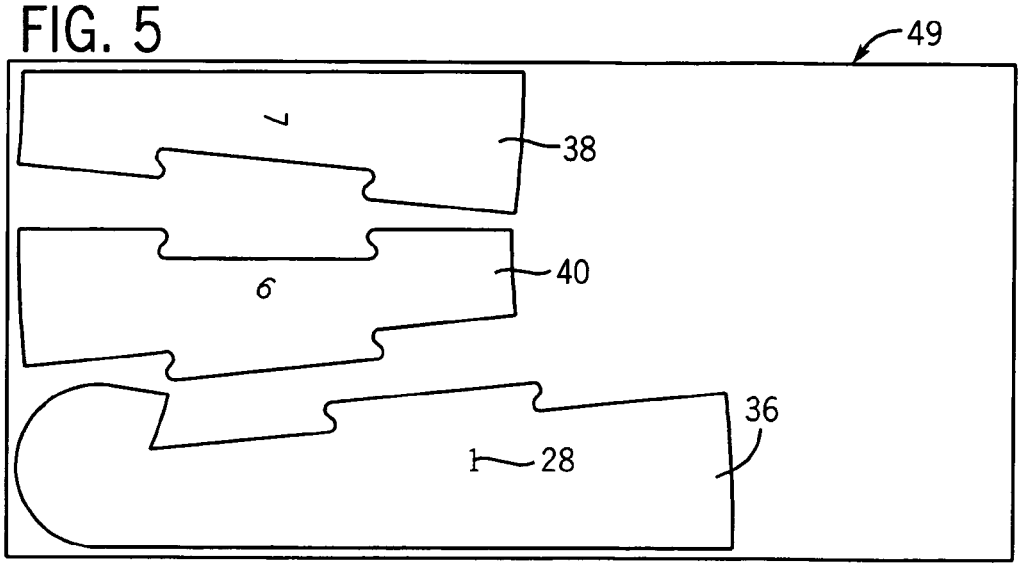
FIGS. 5-7 illustrate one possible arrangement of the shapes of the staircase template pieces in a box representing a sheet of material from which the staircase template pieces will be machined to produce a template in accordance with one embodiment of the present invention.
Figure 6:
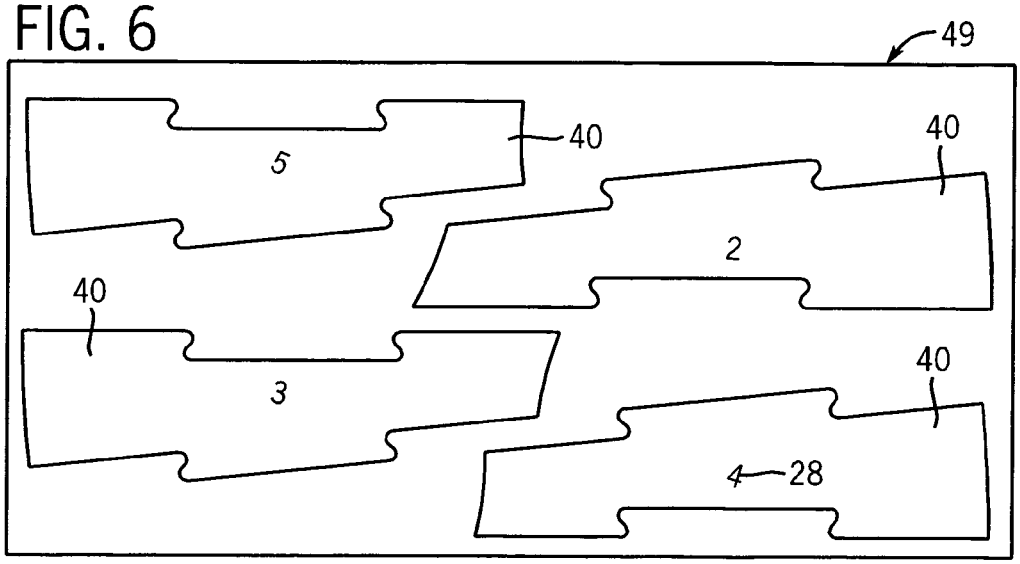
Figure 7:
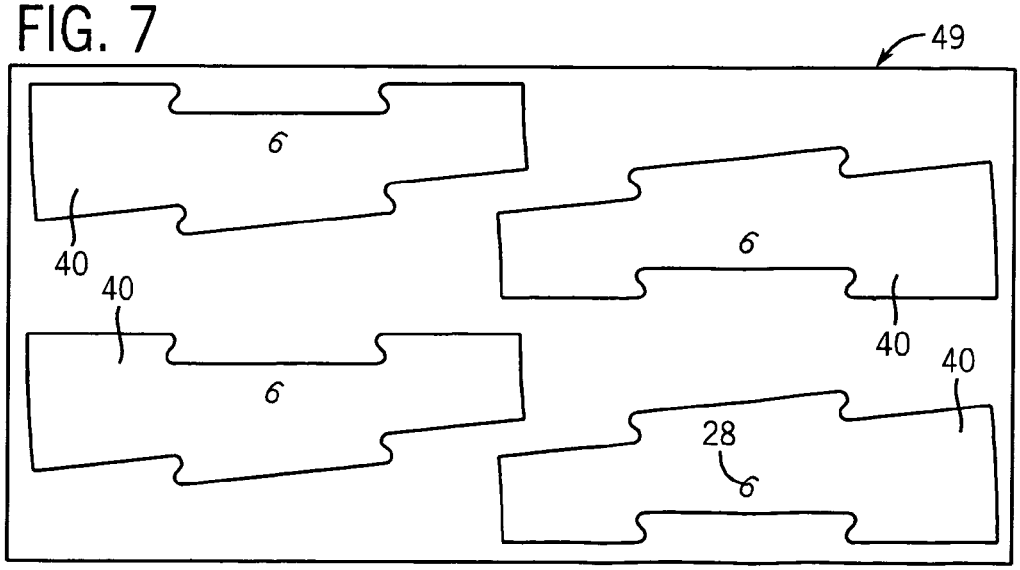

FIGS. 5-7 illustrate one possible arrangement of the shapes of the staircase template pieces in a box representing a sheet of material from which the staircase template pieces will be machined to produce the template of the present invention. As shown, a box 49 is drawn to represent the sheet of material from which the staircase template pieces will be machined. It has been found to be advantageous to use 96"×48" sheets of ¼" plywood as the material for the template, and thus the box 49 is drawn to represent a 96"×48" sheet. The shapes of the staircase template pieces 36, 38, 40 are then drawn in an arrangement that allows as many staircase template pieces to be machined from the sheet as is possible given the shape and dimension of the staircase template pieces, as shown. Other material types and sizes can also be used.

Once the drawings of the individual pieces arranged on a sheet of material are complete, the drawings can be used to machine the staircase template pieces from a sheet of suitable material using a CNC or other manufacturing process. Each staircase template piece can then be labeled according to the drawing labels 28. Additionally, the top staircase template piece 38 and the bottom staircase template piece 36 can be labeled as such. The staircase template pieces can then be shipped to the construction site for assembly. Instructions and drawings to aid in the template's assembly at the construction site can also be included.

If desired, the template system can also include interlocking framing wall plates to provide an accurate and efficient system for framing walls to the exact radius or other dimension that the staircase will be manufactured. The framing wall plates can fit exactly to the staircase template pieces of the present invention described above, and, when assembled, form a full-scale template for framing the staircase. The wall plates can be manufactured using methods similar to those described above using CAD drawings and CNC machining. As well, other methods for manufacturing the wall plates could be used.

FIG. 8 is a detail plan view showing sections A and B of FIG. 2 illustrating one embodiment of the framing wall plates of the present invention. The wall plates 51, 52, 53 are shown flush with the staircase template pieces 40. To ensure proper positioning, wall plates 51, 52, 53 could also be made to interlock with the staircase template pieces 40. In addition, the wall plates can be shaped to interlock with each other. Interlocking the wall plates with each other and with the staircase template pieces can help ensure a consistent radius at the time of framing. FIG. 10A shows wall plate 51 interlocking with wall plate 52 and FIG. 10B shows wall plate 52 interlocking with wall plate 53. The wall plates could also be shaped such that when assembled, they abut each other but do not interlock or otherwise attach to each other, or to the staircase template pieces.

FIG. 9 is a detail plan view showing section C of FIG. 2 illustrating another embodiment of the framing wall plates of the present invention. The wall plates 54, 55 are shown flush with balcony 24. They could also be made to interlock with the staircase template pieces of the present invention. Like the wall plates 51-53, the wall plates 54, 55 can be shaped to interlock with each other. FIG. 10C shows wall plate 54 interlocking with wall plate 55. Again, the wall plates do not need to interlock with each other or the staircase template pieces, but it has been found advantageous to use interlocking wall plates.

FIGS. 11 and 12 show the finished shapes of the wall plates 51-55, and FIG. 13 shows the arrangement of the wall plates 51-55 in a box 49 representing the sheet of material from which the wall plate portions will be machined. It has been found effective to use 96"×48" sheets of ¾" plywood as the material for the wall plates, but other material types and sizes could also be used.

Figure 14:
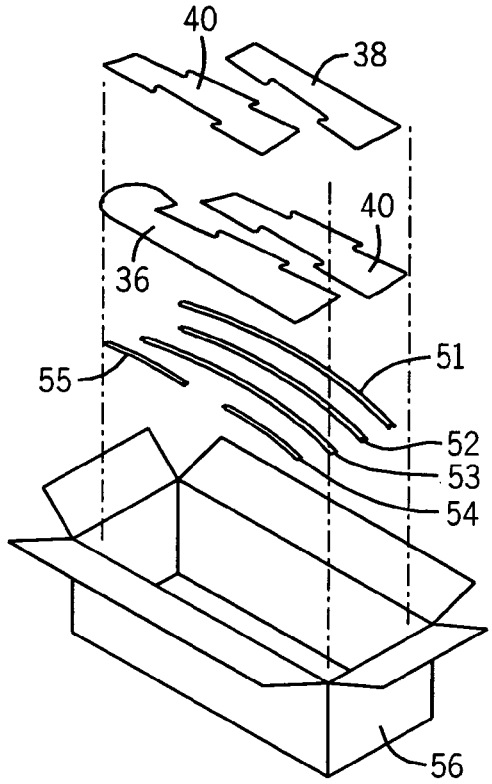
FIG. 14 is an exploded view of the wall plates and staircase template pieces placed in a shipping container.

As described above for the staircase template pieces, once the drawings of the wall plates arranged on a sheet of material are complete, the drawings can be used to machine the wall plates from a sheet of suitable material using a CNC or other machining process. The wall plates can be arranged to use as much of the sheet of material as possible. Each wall plate of the template can then be labeled to aid in the assembly process. For example, the ends of each wall plate can be labeled with a number or letter that matches a number or letter of the corresponding, interlocking end of another wall plate. In FIG. 13, for instance, one end of wall plate 51 is marked with a letter "A" and the corresponding interlocking end of wall plate 52 is also marked with a letter "A." The wall plates can then be shipped to the construction site for assembly. The wall plates and staircase template pieces can be machined in sizes suitable for shipping in a box or other light commercial shipping container with the United Parcel Service or similar light commercial shipping vendor, and can be shipped together in one or more shipping boxes 56 as shown in FIG. 14.

Balcony templates can also be included in the template system of the present invention. The balcony templates, when assembled, form a full-scale template of the balcony of a staircase. Balcony templates can be manufactured in a fashion analogous to that described above for the wall plates and the staircase template pieces, and can have analogous features. For example, the balcony templates can be manufactured using CAD drawings and CNC machining, and can be shaped to interlock with each other and with the staircase template pieces. Other manufacturing methods could be used, as well as other shapes that do not interlock. The balcony templates can then be shipped to the construction site for assembly, either separate from or together with the wall plates and tread pieces.

Figure 15:
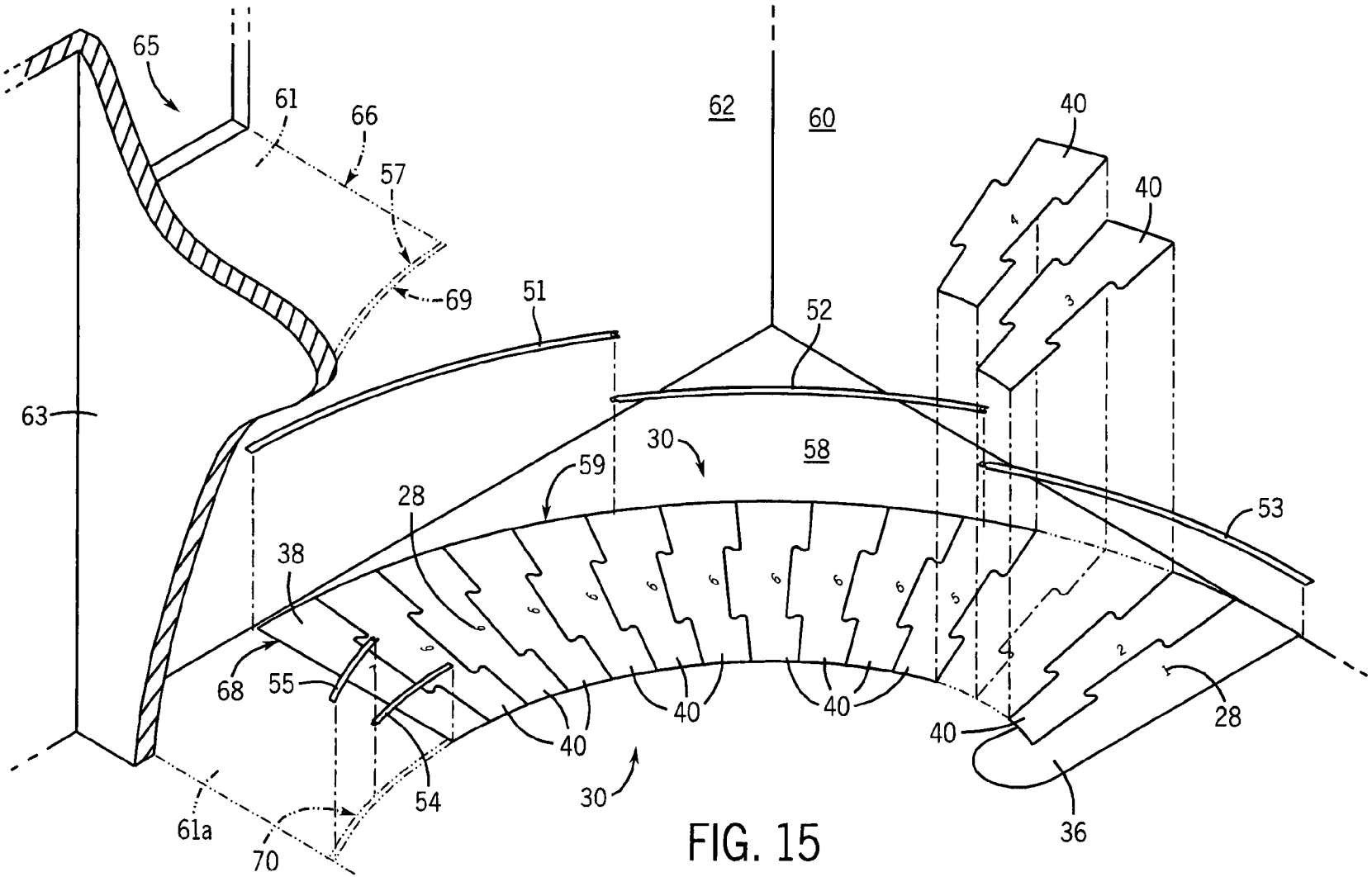
FIG. 15 is a partially exploded perspective view of one embodiment of the template of the present invention illustrating the assembly of the wall plates and staircase template pieces on a lower floor of a building.

FIG. 15 is a partially exploded perspective view of one embodiment of the template of the present invention illustrating the assembly of the wall plates and staircase template pieces on a lower floor level of a building. FIG. 15 shows a lower floor 58, a first wall 60, a second wall 62, and a third wall 63. The staircase template pieces 36, 38, 40 of the template 30 are placed on the lower floor 58, in interlocking fashion in an order corresponding to the numbers on the labels 28. The wall plates 51-53 are placed in an interlocking fashion along the outside edge 59 of the staircase template pieces, and the wall plates 54, 55 are placed in an interlocking fashion along the outside edge 57 of the future location 61 of the balcony, as projected to the lower floor level 61a as line 70. Balcony templates can also be included in the template and placed on the lower floor in the future location 61 of the balcony, as projected to the lower floor level 61*a*. It has been found beneficial to include a CAD drawing and instructions with the template, so that the template can be accurately assembled and placed on the lower floor 58.

Figure 16:
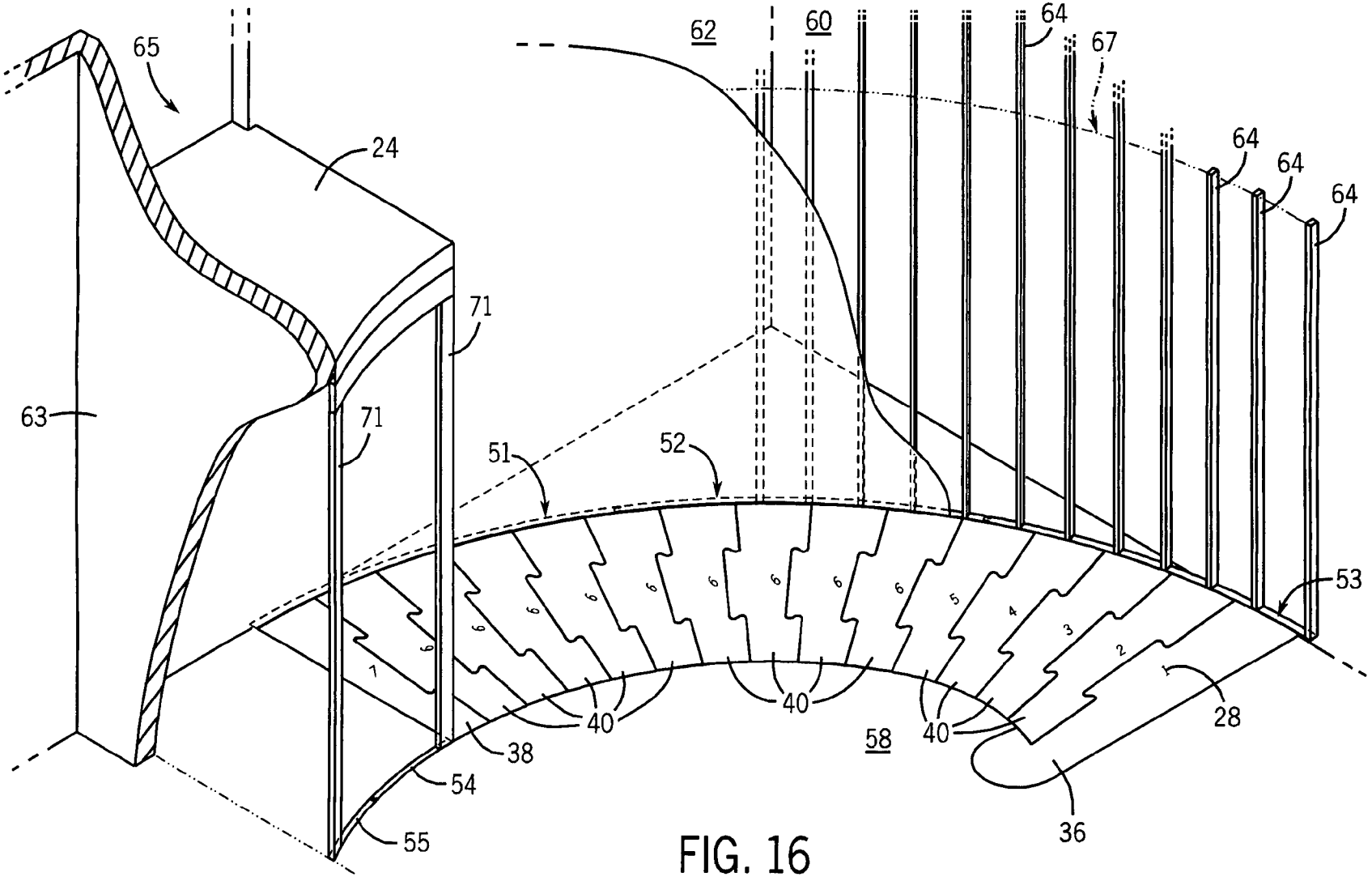
FIG. 16 is a perspective view of one embodiment of the template of the present invention assembled on a lower floor of a building, illustrating the use of the template to place framing for a staircase.

One method of assembling the template at the construction site has been found particularly effective. Referring again to FIG. 15, first the header 66 of the upper floor 65 where the top of the staircase will terminate is located. The line of the header 66 is then transferred or projected down to the lower floor 58 below, using a plumb bob, laser lines or other suitable method. The back edge 68 of the top piece 38, preferably marked "top of stair," can then be aligned with the header line on the floor and tacked in place. The rest of the staircase template pieces 40 can then be assembled, in order according to their labels 28, until the bottom staircase template piece 36, preferably labeled "bottom of stair," is assembled in place. Alternatively, the staircase template pieces 36, 38, 40 can be assembled and then moved to the proper location as one unit. Once the staircase template pieces are assembled and in the proper location, the wall plates can be placed on the lower floor. The inside radius of the wall plates 51-53 will align with the outside radius of the assembled staircase template pieces. Once the wall plate 51 is tacked in place, wall plate 52 can be interlocked to wall plate 51 and tacked in place, and then wall plate 53 can be interlocked with wall plate 52 and tacked in place. Wall plates 54, 55 can be placed in the proper location by aligning them with a line 70 projected from the future location 61 of the balcony. Once the wall plates 51-55 are assembled in place, a line of the wall plates 51-55 can be transferred to the upper floor 65, preferably the upper floor decking, using a plumb with a straight edge, laser lines, or other suitable method. The line 67 transferred for wall plates 51-53 is shown in FIG. 16, and the line 69 transferred for the wall plates 54, 55 is shown in FIG. 15.

Figure 17:
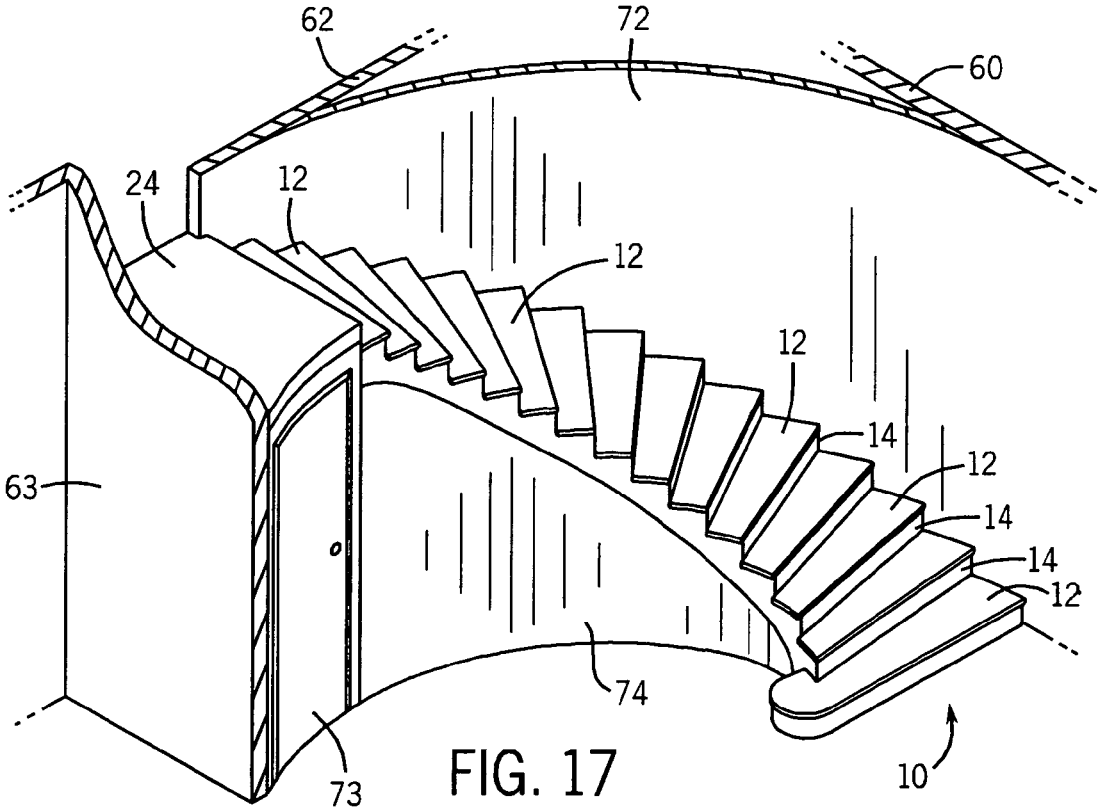
FIG. 17 is a perspective view of a staircase with curved wall framing installed using the template of the present invention.

Once the template is assembled at the construction site, it can be used to accurately and efficiently frame and install the staircase. As shown in FIG. 16, the wall plates 51-53 can be used to accurately place the wall framing studs 64 that will determine the shape of the curved wall 72, shown in FIG. 17. It has been found beneficial to use a framing stud 64 placement of four to eight inches on center, but other stud placement and spacing is possible. Once the framing studs 64 are placed, the staircase 10 can be installed and the curved wall 72 can be finished, as shown in FIG. 17. As shown in FIG. 16, wall plates 54, 55 can be used to accurately place the framing studs 71 for the doorway 73, shown in FIG. 17. Wall plates can also be used for walls built under the staircase 10, such as wall 74 shown in FIG. 17. Those wall plates can be placed after the staircase 10 is installed and used to accurately place the wall framing studs.

While the invention has been described with reference to preferred embodiments, those skilled in the art will appreciate that certain substitutions, alterations and omissions may be made to the embodiments without departing from the spirit of the invention. Accordingly, the foregoing description and embodiments discussed is meant to be exemplary only, and should not limit the scope of the invention.

What is claimed is:

1. A template system for installing a staircase, the template system comprising:

a plurality of staircase template pieces, the staircase template pieces dimensioned to form a full-scale template of the staircase in plan view when the staircase template pieces are placed in spaced-relation to each other; and a plurality of wall plates, the wall plates dimensioned to form a full-scale template for framing the staircase when the wall plates are placed in spaced-relation to each other.

2. The template system of claim 1, wherein the staircase template pieces are dimensioned such that when a first staircase template piece is placed in spaced-relation to a second staircase template piece, the first staircase template piece interlocks with the second staircase template piece.

3. The template system of claim 1, wherein the staircase template pieces are manufactured using CAD drawings and CNC machining.

4. The template system of claim 1, wherein the staircase template pieces are dimensioned such that the staircase template pieces can be shipped in a light commercial shipping container.

5. The template system of claim 1, wherein the full-scale template of the staircase can be moved as a single unit.

6. The template system of claim 1, wherein the wall plates are placed in connection with the staircase template pieces.

7. The template system of claim 1, wherein the wall plates are dimensioned such that when a first wall plate is placed in spaced-relation to a second wall plate, the first wall plate interlocks with the second wall plate.

8. The template system of claim 1, wherein the wall plates are manufactured using CAD drawings and CNC machining.

9. The template system of claim 1, wherein the wall plates are dimensioned such that the wall plates can be shipped in a light commercial shipping container.

10. The template system of claim 1, further comprising a plurality of balcony template pieces, the balcony template pieces dimensioned to form a full-scale template for a balcony of the staircase when the balcony template pieces are placed in spaced-relation to each other.

11. The template system of claim 10, wherein the balcony template pieces are placed in connection with the staircase template pieces.

12. The template system of claim 10, wherein the balcony templates are dimensioned such that when a first balcony template piece is placed in spaced-relation to a second balcony template piece, the first balcony template piece interlocks with the second balcony template piece.

13. The template system of claim 10, wherein the balcony template pieces are manufactured using CAD drawings and CNC machining.

14. The template system of claim 10, wherein the balcony template pieces are dimensioned such that the balcony template pieces can be shipped in a light commercial shipping container.

15. A method for installing a staircase, the method comprising the steps of:

providing a template system having a plurality of staircase template pieces and a plurality of wall plates;

assembling the staircase template pieces on a lower floor to form a full-scale template of the staircase in plan view;

assembling the wall plates on the lower floor to form a full-scale template for framing the staircase;

completing the framing according to the template for the framing; and installing the staircase according to the template for the staircase.

16. The method of claim 15, wherein the step of assembling the staircase template pieces includes the steps of locating a header on an upper floor where the staircase will terminate, transferring a line of the header down to the lower floor below, aligning a top staircase template piece of the plurality of staircase template pieces with the transferred line of the header, and interlocking the plurality of staircase template pieces together.

17. The method of claim 15, wherein the step of completing the wall framing includes transferring a line of the wall plates to an upper floor decking.

18. A staircase installation guide comprising:

a plurality of staircase template pieces that can be assembled at a building location;

a plurality of wall plates that can be assembled in connection with the staircase template pieces; and wherein the assembled staircase template pieces and the assembled wall plates form a full-scale template that can be used to frame and install a staircase.

* * * * *